US012178329B1

(12) United States Patent
Sporbeck

(10) Patent No.: US 12,178,329 B1
(45) Date of Patent: Dec. 31, 2024

(54) TRAVEL PILLOW AND CHILD CARRIER ACCESSORY FOR LUGGAGE

(71) Applicant: Jessica Mellicent Sporbeck, Charlotte, NC (US)

(72) Inventor: Jessica Mellicent Sporbeck, Charlotte, NC (US)

( * ) Notice: Subject to any disclaimer, the term of this patent is extended or adjusted under 35 U.S.C. 154(b) by 83 days.

(21) Appl. No.: 18/072,902

(22) Filed: Dec. 1, 2022

(51) Int. Cl.

| | |
|---|---|
| ***A45C 13/30*** | (2006.01) |
| ***A45C 9/00*** | (2006.01) |
| ***A47C 7/42*** | (2006.01) |
| ***A47C 20/02*** | (2006.01) |
| ***A47D 1/10*** | (2006.01) |
| *A45C 13/26* | (2006.01) |

(52) U.S. Cl.
CPC ..... *A47D 1/10* (2013.01); *A47C 7/42* (2013.01); *A47C 20/02* (2013.01); *A45C 2009/002* (2013.01); *A45C 13/262* (2013.01); *A45C 2013/306* (2013.01)

(58) Field of Classification Search
CPC ..... A47C 7/383; A47C 7/42; A47C 7/425; A47G 9/10; A45C 2013/306; A45C 2009/002
See application file for complete search history.

(56) References Cited

U.S. PATENT DOCUMENTS

| | | | | |
|---|---|---|---|---|
| 5,503,456 | A * | 4/1996 | Rossini | A47C 7/425 224/586 |
| 6,149,234 | A * | 11/2000 | Daniels | A47C 31/11 297/229 |
| 6,748,615 | B1 * | 6/2004 | Tiedemann | A47C 7/383 5/636 |
| 7,793,970 | B2 | 9/2010 | Fegler | |
| 8,662,267 | B1 | 3/2014 | Hart | |
| 9,138,072 | B1 * | 9/2015 | Sanders | A47G 9/0253 |
| 10,611,393 | B1 | 4/2020 | Simon | |
| 11,278,129 | B2 | 3/2022 | Reninaro | |
| D952,340 | S | 5/2022 | Lacerda Braga | |
| 11,383,626 | B1 * | 7/2022 | Teague | A47C 7/425 |
| 2004/0021353 | A1 | 2/2004 | Lozano | |
| 2004/0066069 | A1 | 4/2004 | Caldana | |
| 2008/0047987 | A1 * | 2/2008 | Price | A47D 13/025 224/159 |
| 2009/0289480 | A1 | 11/2009 | McFarland | |
| 2012/0161408 | A1 | 6/2012 | Sidhu | |

(Continued)

FOREIGN PATENT DOCUMENTS

| | | | | |
|---|---|---|---|---|
| WO | WO-2006039373 A2 * | 4/2006 | | A45C 13/30 |
| WO | WO-2014135094 A1 * | 9/2014 | | A45C 13/30 |

(Continued)

*Primary Examiner* — Timothy J Brindley
(74) *Attorney, Agent, or Firm* — Kyle A. Fletcher, Esq.

(57) ABSTRACT

The travel pillow and child carrier accessory for luggage comprises a pouch, a cover flap, a left strap, a right strap, and a cushion insert. The pouch and the cover flap may be a container for holding the cushion insert. The pouch may form a child carrier by removably coupling to a telescoping handle of an item of luggage via the left strap and the right strap such that the pouch and the cushion insert are adapted to function as a back support and the item of luggage as a seat. The pouch May form a pillow by folding and concealing the left strap and the right strap under the cover flap.

15 Claims, 8 Drawing Sheets

(56) References Cited

U.S. PATENT DOCUMENTS

| | | | | |
|---|---|---|---|---|
| 2015/0123439 | A1* | 5/2015 | Jordan | A47C 31/113<br>297/228.1 |
| 2015/0314844 | A1* | 11/2015 | Sellmeyer | B63C 9/30<br>441/125 |
| 2016/0100689 | A1* | 4/2016 | Wang | A47G 9/1045<br>5/653 |
| 2016/0324323 | A1* | 11/2016 | Jahner | A47C 7/425 |
| 2018/0132633 | A1* | 5/2018 | Krsacok | A47C 7/383 |
| 2019/0008265 | A1* | 1/2019 | Mitchell | A45F 3/02 |
| 2020/0221888 | A1* | 7/2020 | Cable | A47C 16/00 |
| 2020/0237123 | A1* | 7/2020 | Yu | A61F 5/3707 |
| 2020/0305567 | A1 | 10/2020 | Lo | |

FOREIGN PATENT DOCUMENTS

| | | | |
|---|---|---|---|
| WO | 2018071955 | | 4/2018 |
| WO | WO-2018129480 | A1 * | 7/2018 |

* cited by examiner

TRAVEL PILLOW AND CHILD CARRIER ACCESSORY FOR LUGGAGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of travel pillows and child carriers, more specifically, a travel pillow and child carrier accessory for luggage.

Summary of Invention

The travel pillow and child carrier accessory for luggage comprises a pouch, a cover flap, a left strap, a right strap, and a cushion insert. The pouch and the cover flap may be a container for holding the cushion insert. The pouch may form a child carrier by removably coupling to a telescoping handle of an item of luggage via the left strap and the right strap such that the pouch and the cushion insert are adapted to function as a back support and the item of luggage as a seat. The pouch May form a pillow by folding and concealing the left strap and the right strap under the cover flap.

An object of the invention is to provide a pillow that May be adapted to be placed under the head of a user while traveling.

Another object of the invention is to provide a child carrier that may support the back of a child seated on a piece of luggage.

A further object of the invention is to provide a pouch to hold a cushion insert and a cover flap to cover a cushion aperture through which the cushion insert may be inserted and removed from the pouch.

Yet another object of the invention is to provide a left strap and a right strap that may couple the pouch to the telescoping handle of the luggage for use as a child carrier and that may be concealed under the cover flap for use as a pillow.

These together with additional objects, features and advantages of the travel pillow and child carrier accessory for luggage will be readily apparent to those of ordinary skill in the art upon reading the following detailed description of the presently preferred, but nonetheless illustrative, embodiments when taken in conjunction with the accompanying drawings.

In this respect, before explaining the current embodiments of the travel pillow and child carrier accessory for luggage in detail, it is to be understood that the travel pillow and child carrier accessory for luggage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the travel pillow and child carrier accessory for luggage.

It is therefore important that the claims be regarded as including such equivalent construction insofar as they do not depart from the spirit and scope of the travel pillow and child carrier accessory for luggage. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
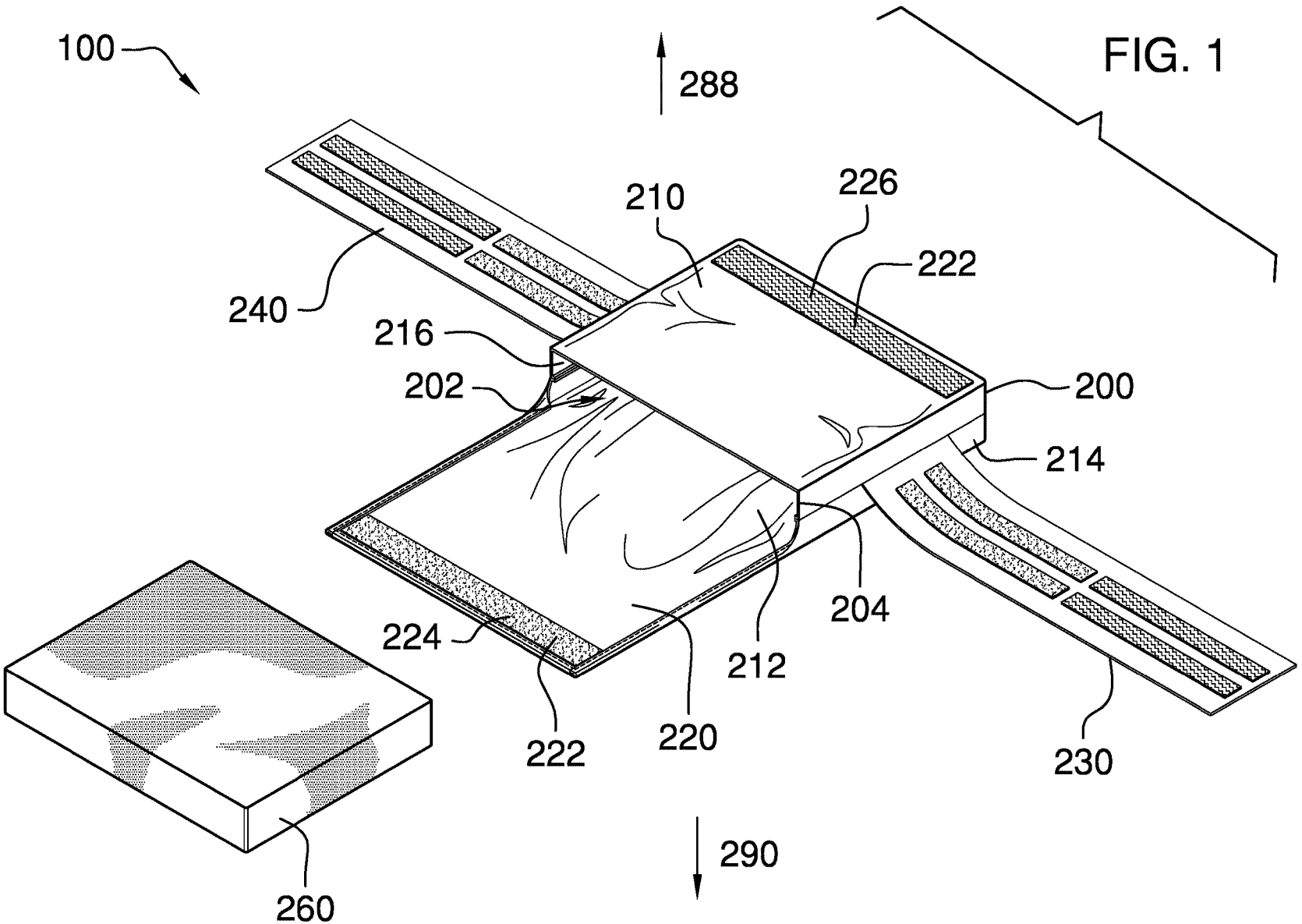
FIG. 1 is an isometric view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 8.

The travel pillow and child carrier accessory for luggage 100 (hereinafter invention) comprises a pouch 200, a cover flap 220, a left strap 230, a right strap 240, and a cushion insert 260. The pouch 200 and the cover flap 220 may be a container for holding the cushion insert 260. The pouch 200 may form a child carrier by removably coupling to a telescoping handle 902 of an item of luggage 900 via the left strap 230 and the right strap 240 such that the pouch 200 and the cushion insert 260 are adapted to function as a back support and the item of luggage 900 as a seat. The pouch 200 may form a pillow by folding and concealing the left strap 230 and the right strap 240 under the cover flap 220.

Figure 2:
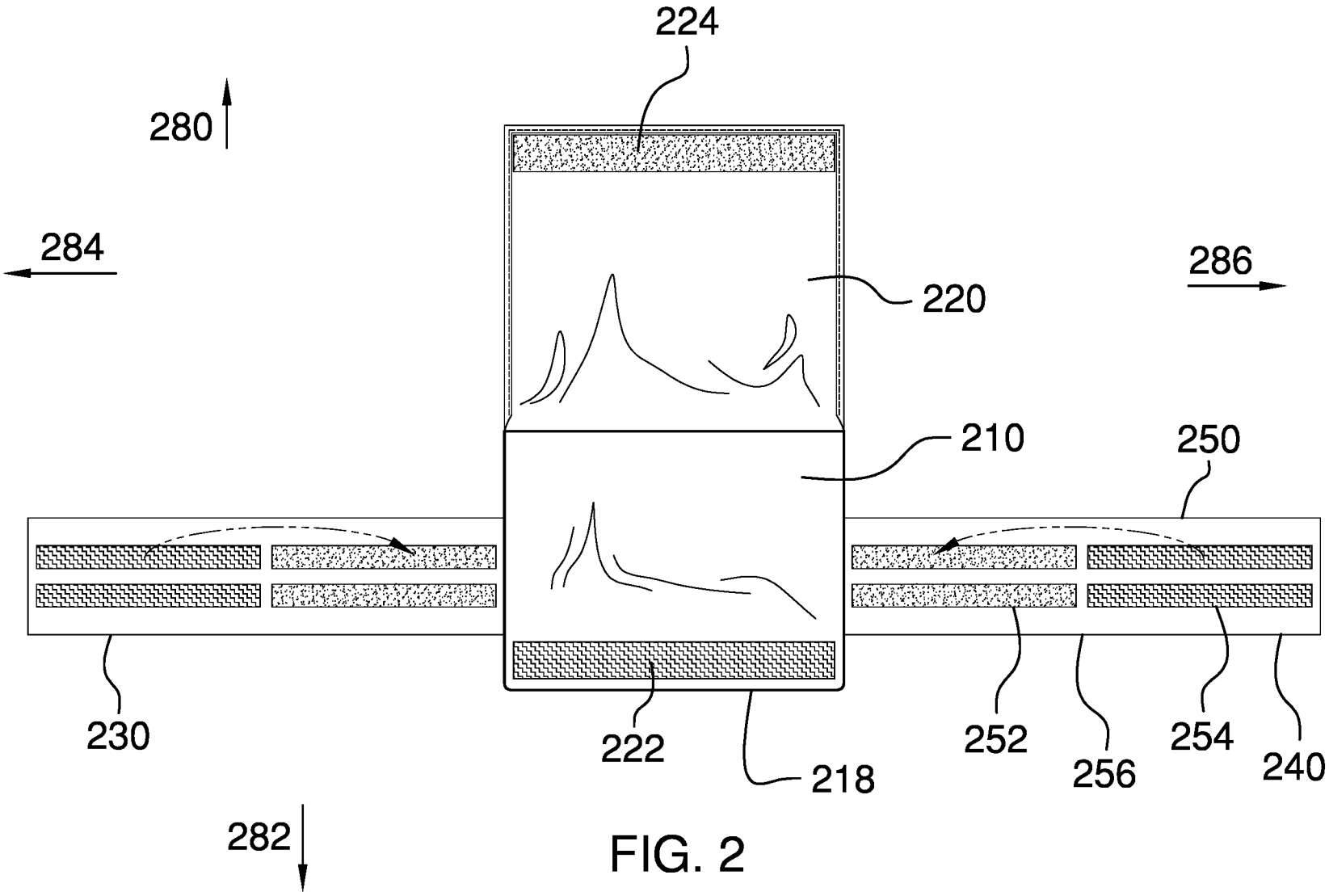
FIG. 2 is a front view of an embodiment of the disclosure.
Figure 3:
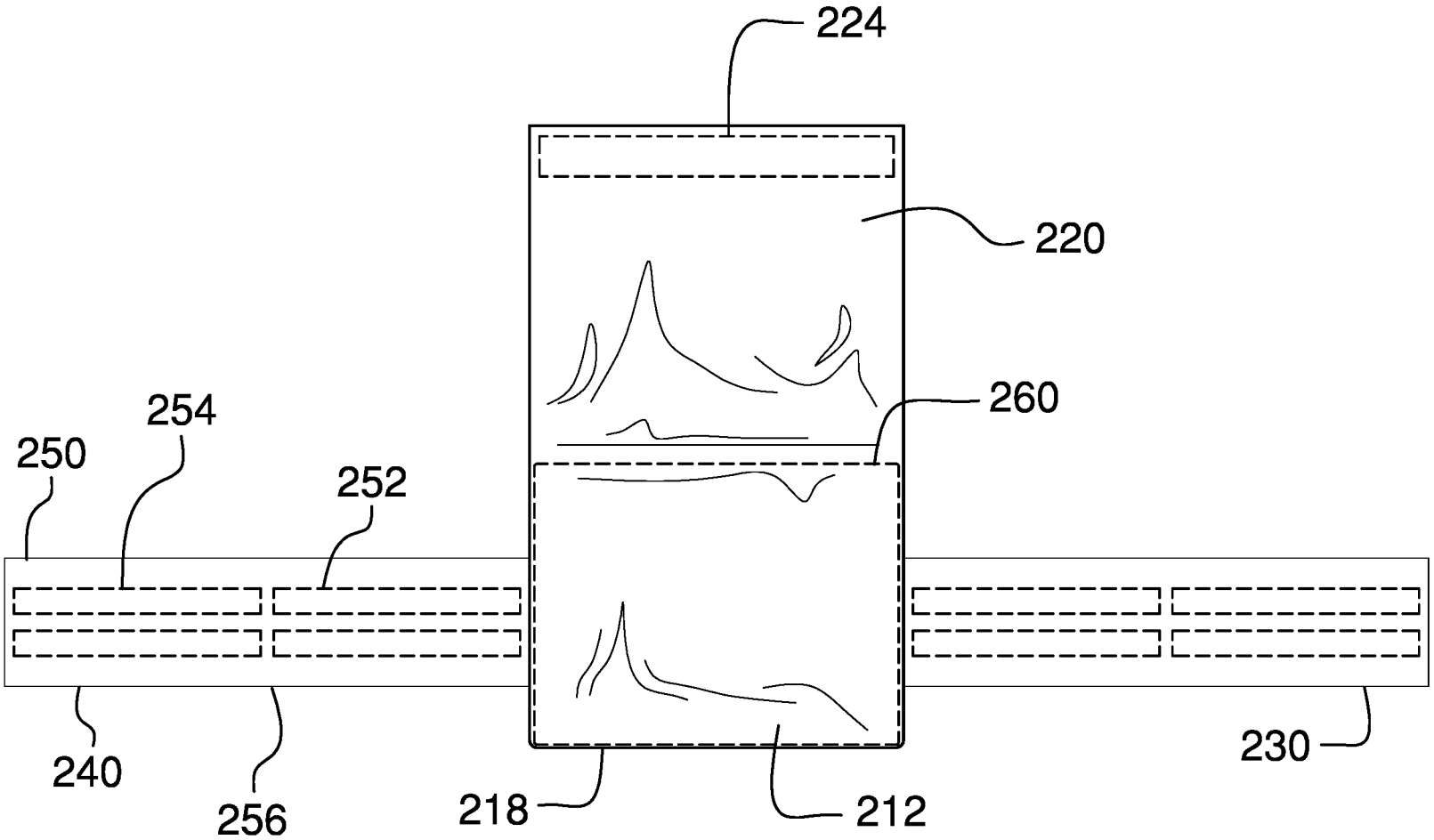
FIG. 3 is a rear view of an embodiment of the disclosure, illustrating the left strap and right strap fully unfolded.
Figure 4:
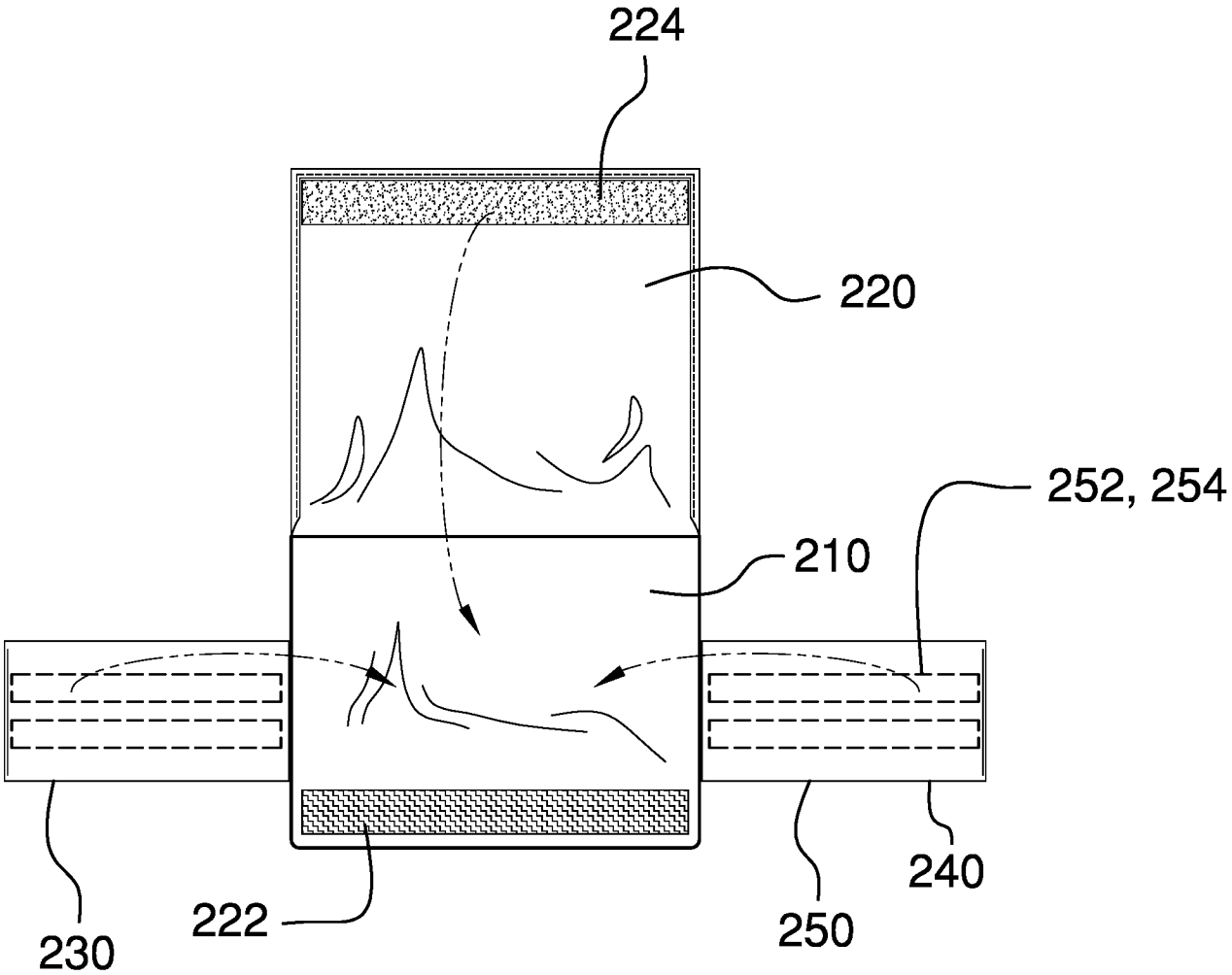
FIG. 4 is a front view of an embodiment of the disclosure, illustrating the left strap and the right strap folded in half.
Figure 5:
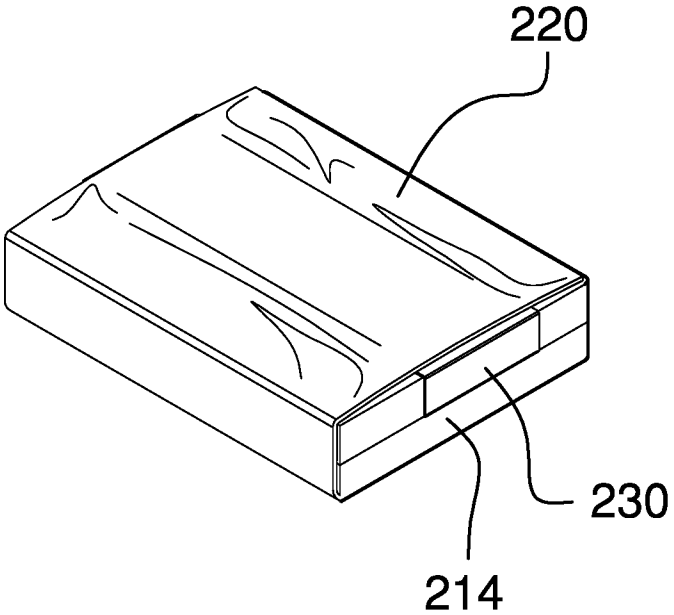
FIG. 5 is an isometric view of an embodiment of the disclosure, illustrating the left strap and the right strap concealed under the cover flap.
Figure 6:
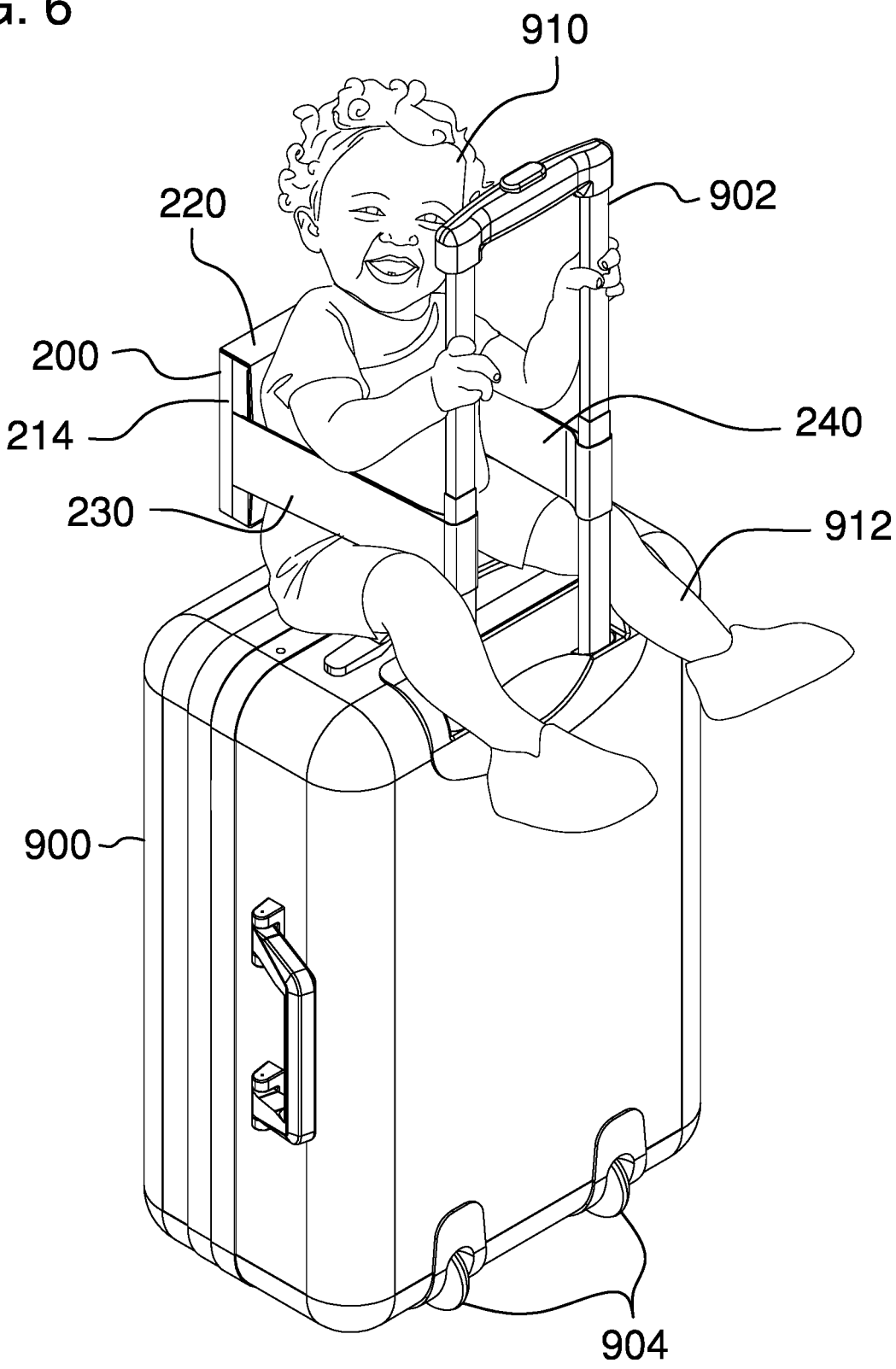
FIG. 6 is an in-use view of an embodiment of the disclosure, illustrating use as a child carrier.
Figure 7:
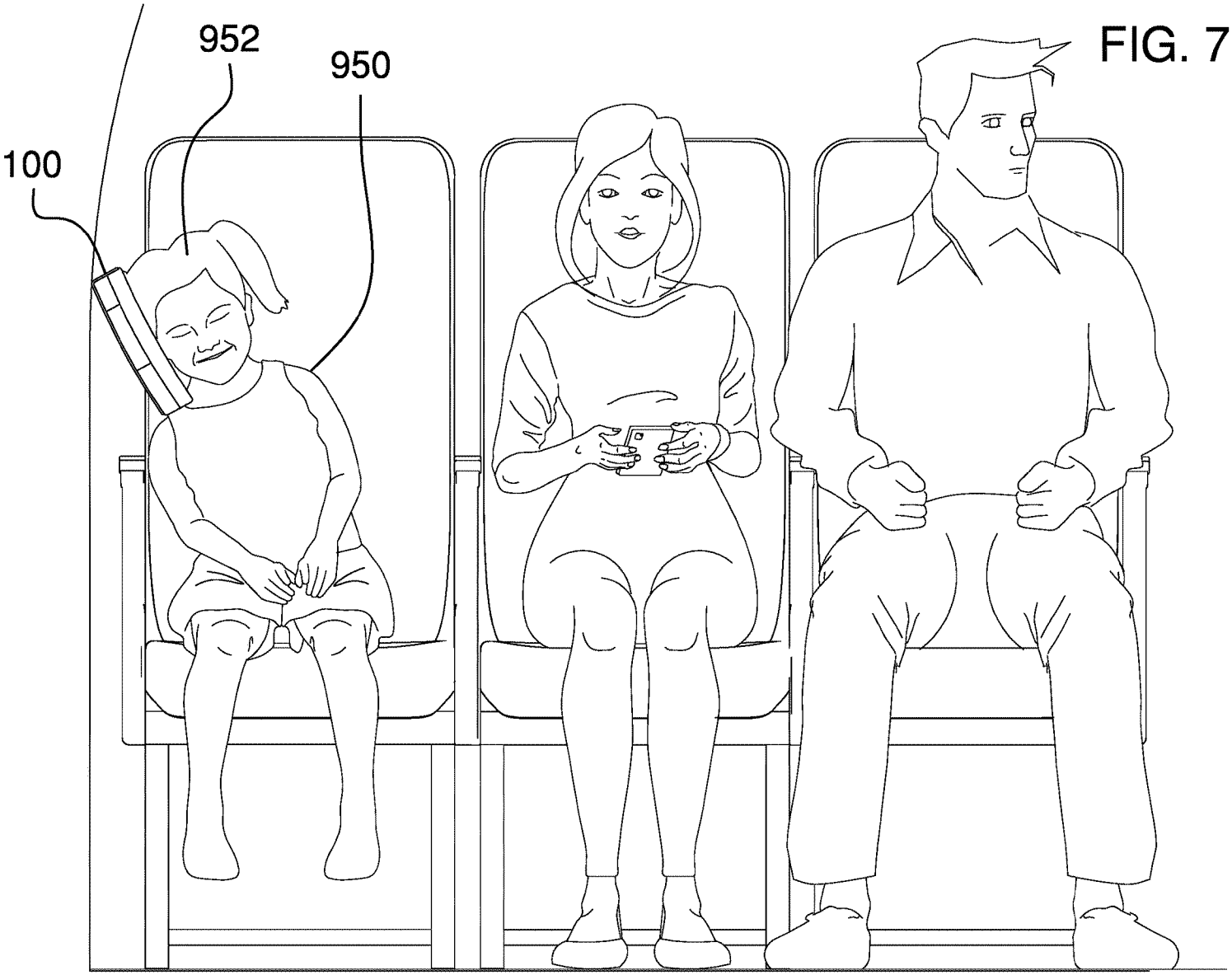
FIG. 7 is an in-use view of an embodiment of the disclosure, illustrating use as a travel pillow.
Figure 8:
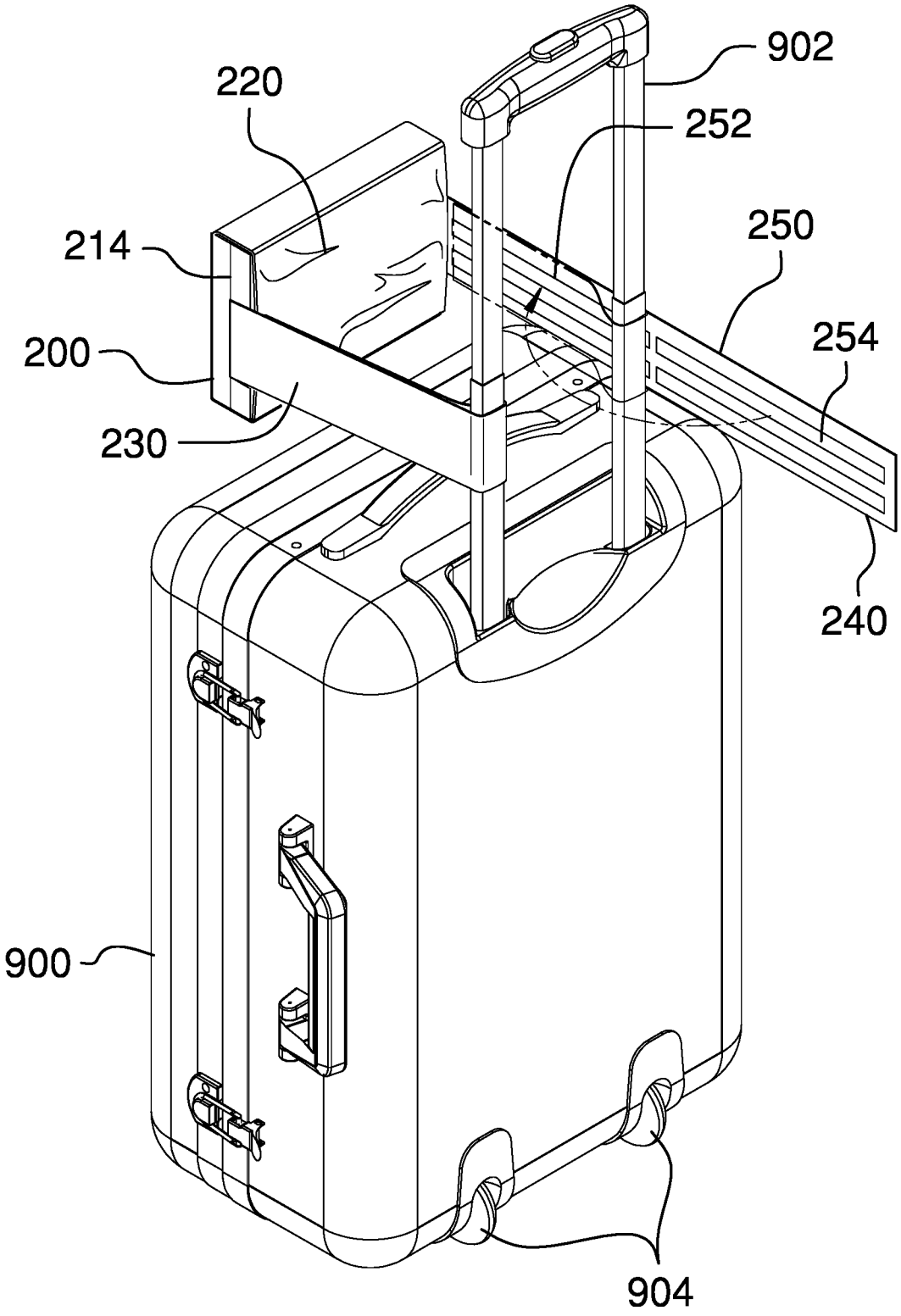
FIG. 8 is a detail view of an embodiment of the disclosure, illustrating coupling of the left strap and right strap to the telescoping handle of the luggage.

Throughout this document, directional references may be given consistent with FIG. 2 where the top 280 and up refer to the top of the page or movement in that direction, the bottom 282 and down refer to the bottom of the page or movement in that direction, the left 284 refers to the left side of the page or movement in that direction, the right 286 refers to the right side of the page or movement in that direction, the front 288 and forward refer to the side facing the viewer or movement towards the viewer, and the rear 290 and rearward refer to side facing away from the viewer or movement away from the viewer.

The pouch 200 may comprise a front panel 210, a rear panel 212, a left side panel 214, a right side panel 216, and a bottom panel 218 interconnected to form the shape of a right rectangular prism. Specifically: The left edge of the front panel 210 may be coupled to the front edge of the left side panel 214. The right edge of the front panel 210 may be coupled to the front edge of the right side panel 216. The bottom edge of the front panel 210 may be coupled to the front edge of the bottom panel 218. The left edge of the rear panel 212 may be coupled to the rear edge of the left side panel 214. The right edge of the rear panel 212 may be coupled to the rear edge of the right side panel 216. The bottom edge of the rear panel 212 may be coupled to the rear edge of the bottom panel 218. The bottom edge of the left side panel 214 may be coupled to the left edge of the bottom panel 218. The bottom edge of the right side panel 216 may be coupled to the right edge of the bottom panel 218.

A cushion aperture 204 at the top 280 of the pouch 200 may provide access to a pocket 202 within the pouch 200. The cushion insert 260 may be placed into and removed from the pouch 200 via the cushion aperture 204. In some embodiments, the pouch 200 may be made from a flexible fabric.

The rear panel 212 may extend upwards to form the cover flap 220. The cover flap 220 may be folded forward to cover the cushion aperture 204 and the front panel 210. The cover flap 220 may be held closed by a flap fastener 222 selected from a plurality of hook and loop fasteners. A first half 224 of the flap fastener 222 may be coupled to the inside top of the cover flap 220. A second half 226 of the flap fastener 222 may be coupled to the outside bottom of the front panel 210. In a preferred embodiment, the first half 224 of the flap fastener 222 may be the loop side of a hook and loop fastener and the second half 226 of the flap fastener 222 may be the hook side of the hook and loop fastener, although those of ordinary skill in the art will recognize that the fastener halves may be reversed without departing from the scope and spirit of the invention 100.

The left strap 230 may be coupled to the center of the left side panel 214 and may extend laterally to the left of the pouch 200. The right strap 240 may be coupled to the center of the right side panel 216 and may extend laterally to the right of the pouch 200. An individual strap 250 selected from the left strap 230 and the right strap 240 may be a rectangular fabric panel.

The front of the individual strap 250 may comprise one or more proximal fastener halves 252 and one or more distal fastener halves 254. The one or more proximal fastener halves may be coupled to the proximal half of the individual strap 250—the half closest to the pouch 200. The one or more distal fastener halves 254 may be coupled to the distal half of the individual strap 250—the half farthest from the pouch 200. The one or more proximal fastener halves 252 may comprise the loop side of a hook and loop fastener and the one or more distal fastener halves 254 may comprise the hook side of a hook and loop fastener, or vice versa. The individual strap 250 may be folded at a midpoint 256 such that the one or more proximal fastener halves 252 may couple to the one or more distal fastener halves 254. The individual strap 250 may couple to the telescoping handle 902 of the item of luggage 900 by folding around the telescoping handle 902 at the midpoint 256 and coupling the one or more proximal fastener halves 252 to the one or more distal fastener halves 254.

The lateral length of the individual strap 250 as measured from the pouch 200 to the distal end of the individual strap 250 may be less than twice the lateral width of the front panel 210 such that the individual strap 250 may be folded in half and laid across the front panel 210 without extending beyond the front panel 210.

The cushion insert 260 may comprise foam in the shape of the right rectangular prism. The cushion insert 260 may be sized to fit within the pouch 200 with the cover flap 220 closed.

In some embodiments, the foam may be polyurethane foam. As non-limiting examples, the polyurethane foam may be a medium or high density polyurethane. As a further non-limiting example, the polyurethane foam may be a viscoelastic polyurethane foam—also known as memory foam. In some embodiments, the foam may be latex foam.

In use, the invention 100 may be used to support a child 910 being transported on an item of luggage 900 and may be used as a pillow. As a non-limiting example, the invention 100 may be adapted to support the child 910 sitting on top of the item of luggage 900 with the child's legs 912 straddling the telescoping handle 902 and with the pouch 200 holding the cushion insert 260 positioned behind the child 910. The invention 100 may be adapted to prevent the child 910 from falling rearwards by pulling the child 910 towards the telescoping handle 902 using a left strap 230 and a right strap 240. The invention 100 may simplify the task of moving the item of luggage 900 and the child 910 since both may be pulled by a user 950, thereby taking advantage of the telescoping handle 902 and wheels 904 of the item of luggage 900.

As a further non-limiting example, the left strap 230 and the right strap 240 may each be folded in half and then folded across the front panel 210 of the pouch 200. The left strap 230 and the right strap 240 may then be covered by the cover flap 220. The resulting the pouch 200 with the cushion insert 260 inside the pouch 200 and with the left strap 230 and the right strap 240 retained by the cover flap 220 may be adapted to be used as the pillow by cushioning a user's head 952.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "fastener" may be a device that is used to join or affix two objects. Fasteners May generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used in this disclosure, a "flap" may be a piece of material that is hinged or otherwise attached to a surface using one side. In some embodiments, the piece of material may hang in such a way as to cover a hole in a surface, to provide a barrier between objects, or to provide a grasping point.

As used in this disclosure, "flexible" may refer to an object or material which will deform when a force is applied to it, which will not return to its original shape when the deforming force is removed, and which may not retain the deformed shape caused by the deforming force.

As used herein, "handle" may refer to an object by which a tool, object, or door is held or manipulated with the hand.

As used in this disclosure, a "hook and loop fastener" may be a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used in this disclosure, the word "lateral" may refer to the sides of an object or movement towards a side. Lateral directions are generally perpendicular to longitudinal directions. "Laterally" may refer to movement in a lateral direction.

As used in this disclosure, "luggage" may be a trunk, bag, parcel, suitcase, or backpack in which domestic articles are contained during travel.

As used here, the word "midpoint" may refer to a point that is between the ends of an object. An "exact midpoint" may refer to a midpoint that is equidistant from edges of the object in at least one direction. Unless otherwise stated, a midpoint is not required to be at the exact center of the object but instead May be separated from the exact midpoint by up to 50% of the distance from the exact midpoint to the farthest edge, farthest end, or farthest corner.

As used in this disclosure, a "pillow" may be a rectangular cushion that is used to support the head.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used herein, a "suitcase" may be a container used for transporting clothing and personal possessions. A typical suitcase provides a carrying handle and opens by unzipping or unlatching one of its larger sides. Some suitcases may provide wheels and a telescoping handle for pulling the suitcase around on the wheels. Suitcases are often designated as soft-sided or hard-sided based upon whether they are constructed from a fabric-covered framework or from a rigid material.

As used in this disclosure, "telescopic", "telescoping", and "telescopically" may refer to an object made of two or more sections that fit or slide into each other such that the object can be made longer or shorter by adjusting the relative positions of the sections.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will H readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A travel pillow and child carrier accessory for luggage comprising:

a pouch, a cover flap, a left strap, a right strap, and a cushion insert;

wherein the pouch and the cover flap comprise a container for holding the cushion insert;

wherein the pouch forms a child carrier by removably coupling to a telescoping handle of an item of luggage via the left strap and the right strap such that the pouch and the cushion insert are adapted to function as a back support and the item of luggage as a seat;

wherein the pouch forms a pillow by folding and concealing the left strap and the right strap under the cover flap;

wherein an individual strap selected from the left strap and the right strap is a rectangular fabric panel;

wherein a front of the individual strap comprises one or more proximal fastener halves and one or more distal fastener halves;

wherein the one or more proximal fastener halves are coupled to the proximal half of the individual strap;

wherein the one or more distal fastener halves are coupled to the distal half of the individual strap;

wherein a cushion aperture at the top of the pouch provides accesses to a pocket within the pouch;

wherein the cushion insert is placed into and removed from the pouch via the cushion aperture;

wherein the pouch is made from a flexible fabric;

wherein a rear panel extends upwards to form the cover flap.

2. The travel pillow and child carrier accessory for luggage according to claim 1 wherein the pouch comprises a front panel, the rear panel, a left side panel, a right side panel, and a bottom panel interconnected to form the shape of a right rectangular prism;

wherein the left edge of the front panel is coupled to the front edge of the left side panel;

wherein the right edge of the front panel is coupled to the front edge of the right side panel;

wherein the bottom edge of the front panel is coupled to the front edge of the bottom panel;

wherein the left edge of the rear panel is coupled to the rear edge of the left side panel;

wherein the right edge of the rear panel is coupled to the rear edge of the right side panel;

wherein the bottom edge of the rear panel is coupled to the rear edge of the bottom panel;

wherein the bottom edge of the left side panel is coupled to the left edge of the bottom panel;

wherein the bottom edge of the right side panel is coupled to the right edge of the bottom panel.

3. The travel pillow and child carrier accessory for luggage according to claim 2 wherein the cover flap is folded forward to cover the cushion aperture and the front panel.

4. The travel pillow and child carrier accessory for luggage according to claim 3 wherein the cover flap is held closed by a flap fastener selected from a plurality of hook and loop fasteners.

5. The travel pillow and child carrier accessory for luggage according to claim 4 wherein a first half of the flap fastener is coupled to the inside top of the cover flap;

wherein a second half of the flap fastener is coupled to the outside bottom of the front panel.

6. The travel pillow and child carrier accessory for luggage according to claim 5 wherein the left strap is coupled to the center of the left side panel and extends laterally to the left of the pouch;

wherein the right strap is coupled to the center of the right side panel and extends laterally to the right of the pouch.

7. The travel pillow and child carrier accessory for luggage according to claim 6 wherein the individual strap is folded at a midpoint such that the one or more proximal fastener halves couple to the one or more distal fastener halves.

8. The travel pillow and child carrier accessory for luggage according to claim 7 wherein the individual strap couples to the telescoping handle of the item of luggage by folding around the telescoping handle at the midpoint and coupling the one or more proximal fastener halves to the one or more distal fastener halves.

9. The travel pillow and child carrier accessory for luggage according to claim 7 wherein the lateral length of the individual strap is less than twice the lateral width of the front panel such that the individual strap is folded in half and laid across the front panel without extending beyond the front panel.

10. The travel pillow and child carrier accessory for luggage according to claim 9 wherein the cushion insert comprises foam in the shape of the right rectangular prism.

11. The travel pillow and child carrier accessory for luggage according to claim 10 wherein the cushion insert is sized to fit within the pouch with the cover flap closed.

12. The travel pillow and child carrier accessory for luggage according to claim 11 wherein the foam is polyurethane foam.

13. The travel pillow and child carrier accessory for luggage according to claim 12 wherein the polyurethane foam is a medium or high density polyurethane.

14. The travel pillow and child carrier accessory for luggage according to claim 12 wherein the polyurethane foam is a viscoelastic polyurethane foam.

15. The travel pillow and child carrier accessory for luggage according to claim 11 wherein the foam is latex foam.

* * * * *